US009802164B2

(12) United States Patent
Min

(10) Patent No.: US 9,802,164 B2
(45) Date of Patent: Oct. 31, 2017

(54) LIQUID AERATING DEVICE

(71) Applicant: Byung Eun Min, Seoul (KR)

(72) Inventor: Byung Eun Min, Seoul (KR)

( * ) Notice: Subject to any disclaimer, the term of this patent is extended or adjusted under 35 U.S.C. 154(b) by 0 days.

(21) Appl. No.: 15/069,837

(22) Filed: Mar. 14, 2016

(65) Prior Publication Data

US 2017/0259221 A1 Sep. 14, 2017

(51) Int. Cl.
*B01F 3/04* (2006.01)
*B01F 5/04* (2006.01)

(52) U.S. Cl.
CPC ..... *B01F 3/04794* (2013.01); *B01F 5/0428* (2013.01); *B01F 2003/04872* (2013.01); *B01F 2005/0448* (2013.01); *B01F 2215/0072* (2013.01)

(58) Field of Classification Search
CPC ..... B01F 3/04794; B01F 5/0428; B01F 2003/04872; B01F 2005/0448; B01F 2215/0072
USPC ..... 261/76, DIG. 75
See application file for complete search history.

(56) References Cited

U.S. PATENT DOCUMENTS 585,965 A * 7/1897 Ralph ..... B65D 49/04 215/25
3,386,626 A * 6/1968 Kearney ..... B65D 49/00 222/147
8,011,540 B1 * 9/2011 Peckels ..... B01F 3/04099 222/190
8,251,352 B2 8/2012 Chiorazzi
8,365,964 B2 * 2/2013 Federighi ..... B01F 3/0446 222/190
8,517,350 B2 * 8/2013 Tsai ..... B01F 5/0428 222/190
8,523,019 B2 * 9/2013 Drobot ..... B01F 5/0428 222/152
D702,493 S 4/2014 Tang
8,807,358 B2 * 8/2014 Devoy ..... B01F 3/0446 215/309
2011/0024461 A1 * 2/2011 Kilduff ..... B01F 3/0473 222/190
2012/0111893 A1 * 5/2012 Luebke ..... B01F 3/0446 222/190
2012/0156345 A1 * 6/2012 Agarwal ..... B01F 5/0428 426/474
2013/0140721 A1 * 6/2013 Borden ..... B01F 5/0428 261/76
2014/0252662 A1 * 9/2014 Graham ..... B01F 5/0428 261/76

(Continued)

FOREIGN PATENT DOCUMENTS

CN 2012 3 0327975.7 7/2012

*Primary Examiner* — Charles Bushey
(74) *Attorney, Agent, or Firm* — Innovation Counsel LLP

(57) ABSTRACT

A liquid aerating device is presented. The device includes a first inner channel through which air flows in a first direction, a second inner channel extending substantially parallel to the first inner channel, wherein liquid flows through the second inner channel in a second direction that is opposite of the first direction, and an aeration chamber. The aeration chamber is connected to the first inner channel and the second inner channel, and positioned such that the air flows into the first inner channel from the aeration chamber and the liquid flows out of the second inner channel into the aeration chamber.

9 Claims, 5 Drawing Sheets

(56) References Cited

U.S. PATENT DOCUMENTS

2015/0174537 A1* 6/2015 Foldesi, Jr. ..... B01F 3/04794
261/79.2

* cited by examiner

LIQUID AERATING DEVICE

TECHNICAL FIELD

The disclosure relates to a liquid aerator, and particularly to an aerator that attaches to a bottle to aerate the liquid as it flows out.

BACKGROUND

Some beverages, such as red wine, are often considered to be more enjoyable after they have been exposed to air. There are numerous ways to achieve this aeration. One way is to, upon opening a new bottle of wine, pour the content into a decanter and let it "breathe." Another way to achieve aeration is to open a bottle of wine some period before one plans on drinking it. Yet another way to aerate red wine is to pour the wine into wine funnels or strainers that are designed to divide the liquid into multiple streams, thereby exposing more of the liquid's surface to the air. Although the above technique may be helpful in aerating the wine, they often involve inconvenient extra steps that often result in splashing/spilling or require one to take an action long before he is ready to drink the wine. Furthermore, the degree of aeration that happens may not be enough to bring out the desired flavors in the wine.

An apparatus and method for achieving optimal aeration of a beverage without requiring much planning or cleanup is desired.

SUMMARY OF THE DISCLOSURE

A liquid aerating device is presented. The device includes a first inner channel through which air flows in a first direction, a second inner channel extending substantially parallel to the first inner channel, wherein liquid flows through the second inner channel in a second direction that is opposite of the first direction, and an aeration chamber. The aeration chamber is connected to the first inner channel and the second inner channel, and positioned such that the air flows into the first inner channel from the aeration chamber and the liquid flows out of the second inner channel into the aeration chamber.

DETAILED DESCRIPTION

The beverage aerating device described herein may be attached to the neck portion of a bottle, such that the liquid becomes aerated as it flows out of the bottle through the aerating device. In one embodiment, the aerating device described herein is a venturi apparatus that utilizes Bernoulli's Principle to inject or infuse oxygen from ambient air into liquid that is being poured. The aerating device includes a first inner channel and a second inner channel that extend substantially parallel to each other. As liquid flows out of the bottle through one channel, air gets pulled into the bottle via the other channel, flowing in the opposite direction of the liquid flow. The air is pulled into an aeration chamber where the liquid that is flowing out of the bottle is experiencing a constriction in the flow passage. The constricted flow lowers the internal liquid pressure, making the liquid more susceptible to infusion of oxygen that flows in with the air into the aeration chamber.

Figure 1:
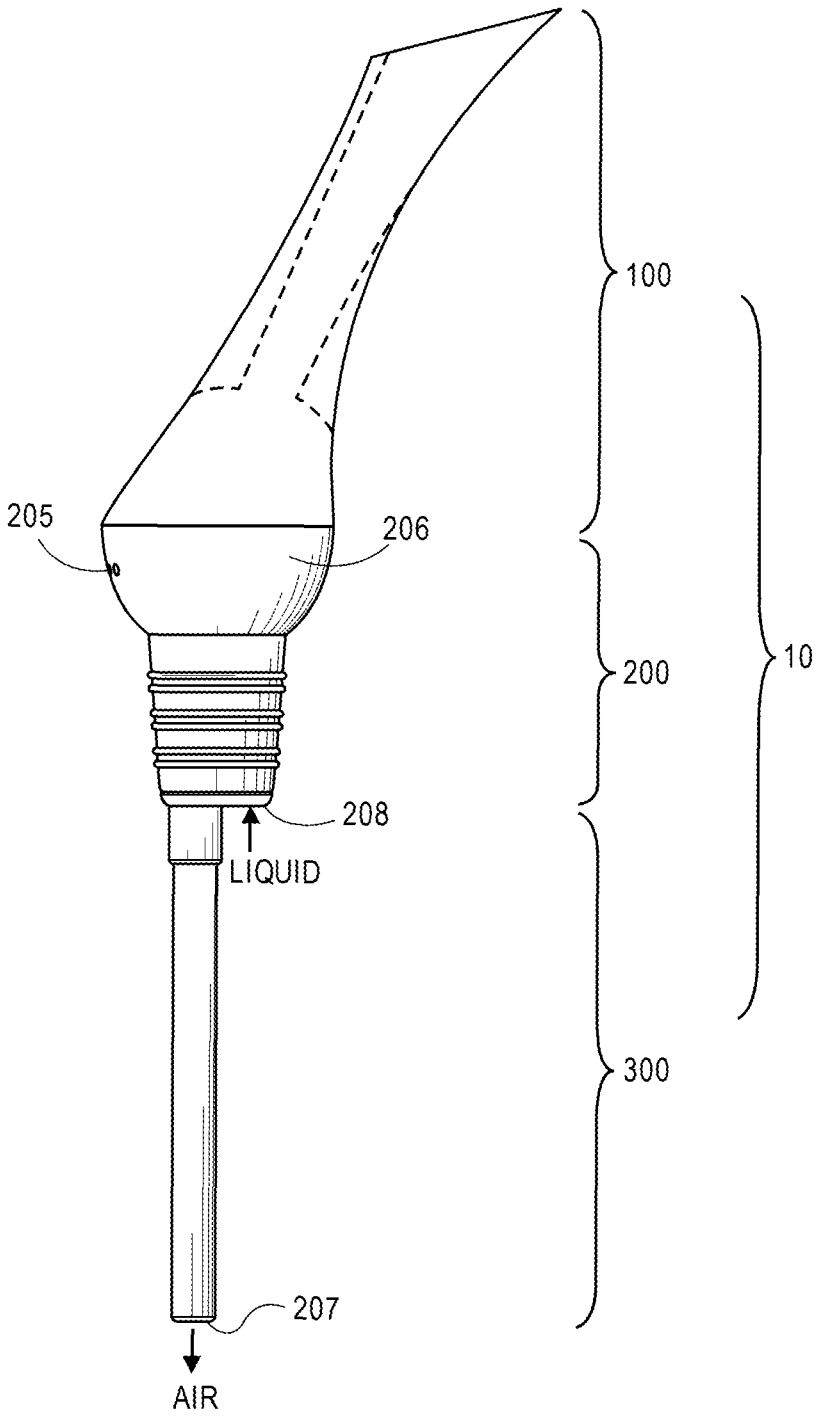
FIG. 1 depicts an aeration device in accordance with one embodiment of the inventive concept.
Figure 2:
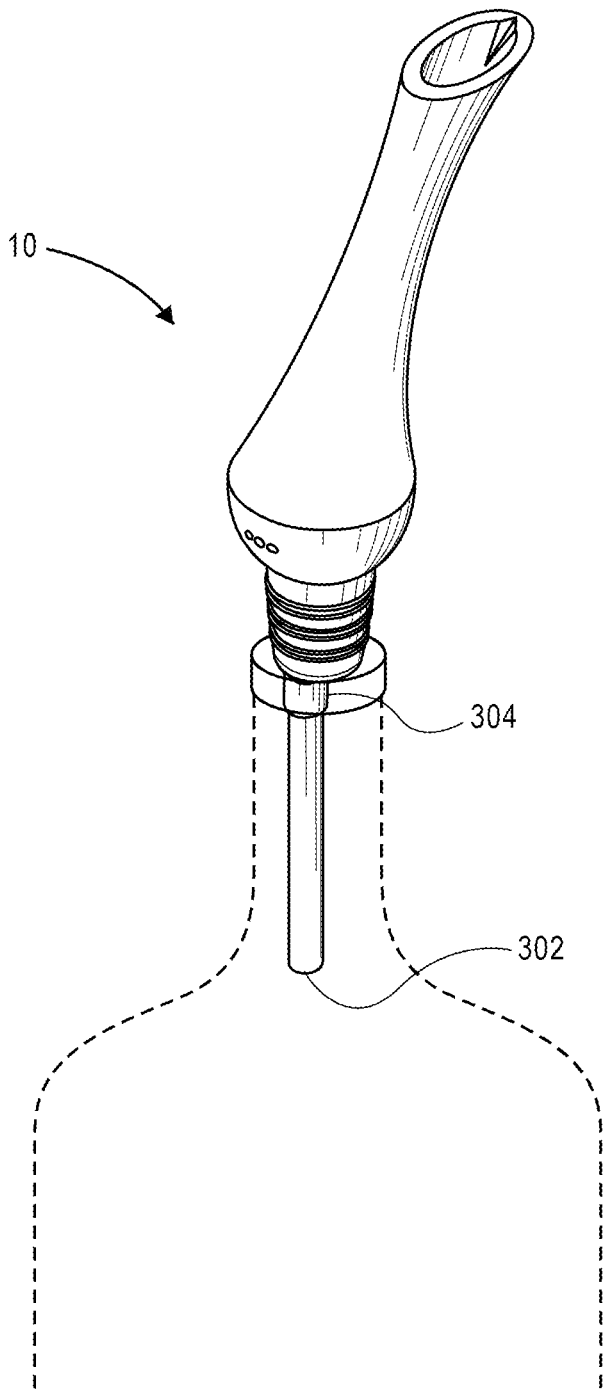
FIG. 2 depicts the aeration device of FIG. 1 combined with a beverage bottle for use.

FIG. 1 depicts an aerating device 10 in accordance with one embodiment of the inventive concept. As shown, the aerating device 10 includes a spout 100, an aerator 200, and a straw 300 that may be assembled together. Relative to the direction in which the straw 300 extends, the centerline of the spout 100 makes about a 150-degree angle (plus or minus 5 degrees) for ease of pouring and minimize dripping. There are four sets of openings in the aerating device 10: holes 205, a first inner channel 207, a second inner channel 208, and the spout 100. In one embodiment, the aeration device 10 is about 5.9 inches long FIG. 2 depicts the aerating device 10 coupled to a bottle for use. The outer cylindrical casing of the aerator 200 is tapered such that it gets narrower with distance from the aeration chamber 206. This tapered shape allows the aerating device 10 to be pushed into the bottle as far as possible to securely and snugly couple with the mouth of the bottle, such that the liquid flows out through the spout 100 with minimal leakage.

The straw 300 extends into the neck of the bottle to the "shoulder" portion of the bottle. The straw 300 has an air outlet 302 through which the air enters the bottle, and an outlet 304 that couples to the aerator 200. When the bottle is full, the air outlet 302 of the straw 300 is submerged in the liquid when the bottle is tilted in a pouring position. When the bottle is less full, the air outlet 302 of the straw 300 is not submerged in the liquid even when the bottle is tilted for pouring. Air enters the aeration chamber 206 through the holes 205, and flows out the straw 300.

Figure 3:
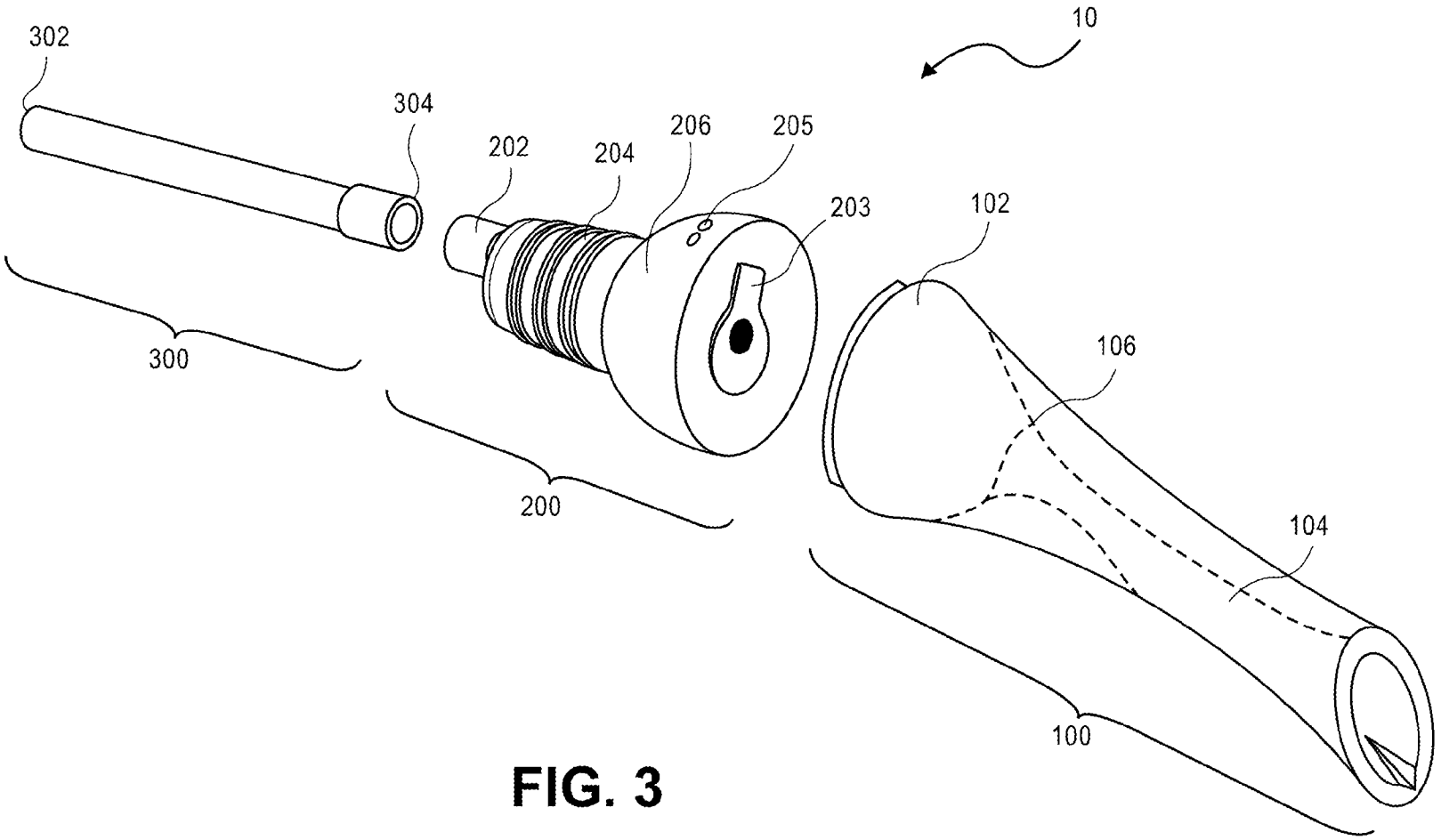
FIG. 3 depicts the aeration device disassembled into three parts.

FIG. 3 depicts the aerating device 10 of FIG. 1 in a disassembled state. As shown, the aerating device 10 is separable into three parts: the spout 100, the aerator 200, and the straw 300. The disassembled state is advantageous for practical reasons, such as ease of cleaning or storing. The spout 100 may be made of any material that retains its shape, such as acrylic, plastic or glass. The spout 100 has a wide inlet portion 102 that is configured to couple with the aerator 200, and a pouring channel 104 that ends at a slanted angle. The wide inlet portion 102 and the pouring channel 104 are joined at a constricted portion 106, which is the narrowest portion of the passage through the spout 100.

The aerator 200 has two inner channels: a first inner channel 207 that extends through a straw attachment portion 202 and a cylindrical casing 204, and a second inner channel 208 that extends only through the cylindrical casing 204. The first and second inner channels 207, 208 extend parallel to each other but separately through the cylindrical casing 204, and both channels open into the aeration chamber 206. In the particular embodiment, the aeration chamber 206 has a partial-sphere shape, with holes 205 extending through its outer wall. The holes 205 are positioned close to the first inner channel 207. A tab 203 is formed in the aeration chamber 206 and partially blocks the second channel 208. There is an opening in the tab 203 that leads into the first inner channel 207.

The straw attachment portion 202 is configured to fit securely with the straw 300, allowing air to flow from the aerator 200 through the straw 300. The cylindrical casing 204 may be tapered such that it gets narrower going from the aeration chamber 206 toward the straw 300. This tapered shape allows a user to push the cylindrical casing 204 into a bottle as far as it will go for a snug, secure coupling. The outer surface of the cylindrical casing 204 may be made of a material that has some "give," such as rubber or an elastic material to ensure a snug fit into a bottle without causing any damage to the bottle or the aerator 200.

When liquid is poured through the aerating device 10, the liquid flows mainly through the second inner channel 208. In the particular embodiment, the second inner channel 208 is a larger channel than the first inner channel 207. As liquid inside the bottle flows out through the second inner channel 208, decreasing the air pressure inside the bottle, air is pulled into the aerator 200 through the aeration holes 205 and travels into the bottle through the first inner chamber 207. The tab 203 narrows the outlet of the second inner channel 208, causing the liquid velocity to increase as it enters the aeration chamber 206. This increase in liquid velocity lowers the pressure in accordance with Bernoulli effect, causing a low-pressure liquid to come in contact with air as it enters the aerator 200 through the holes 205. Further constriction to the liquid flow happens as it flows through the constriction portion 106, again increasing the flow velocity, decreasing internal pressure, and allowing air that entered through the holes 205 to mix with the low-pressure liquid. At the constriction portion 106, optimal amount of oxygen is directly infused into the liquid as it flows.

Figure 4:
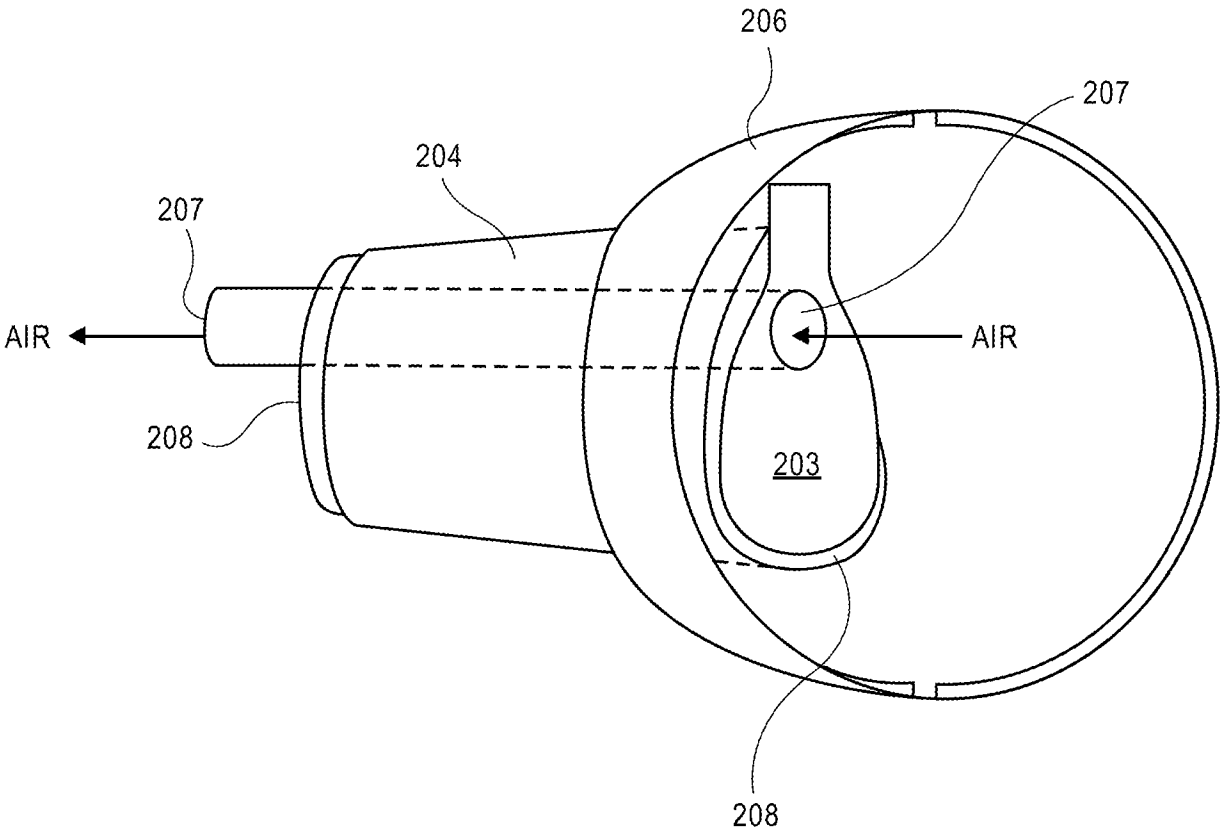
FIG. 4 depicts a perspective view of the aerator of the aeration device.
Figure 5:
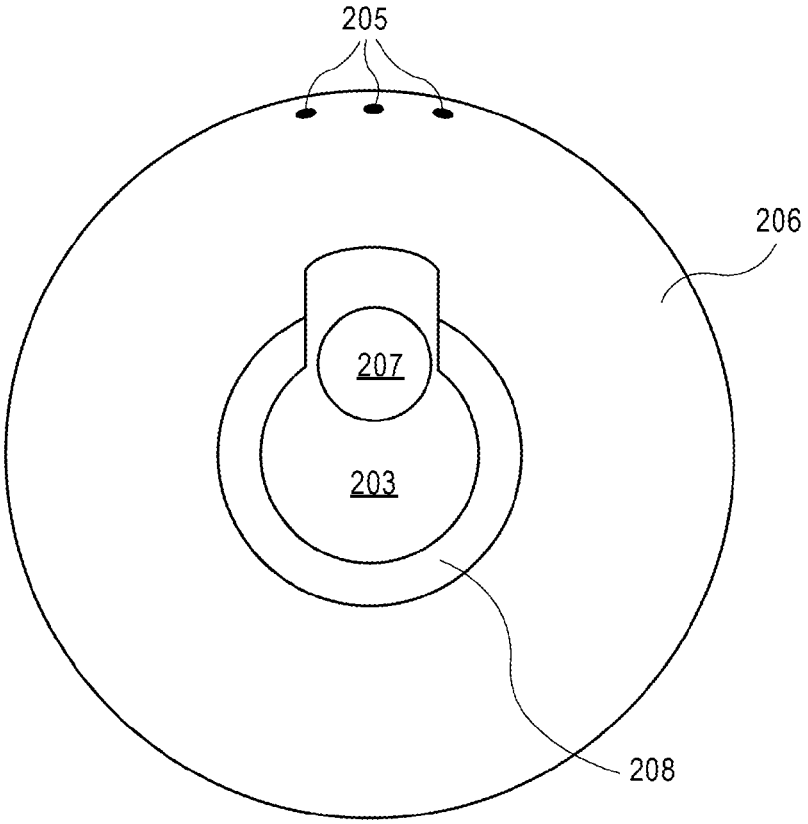
FIG. 5 depicts a front view of the aerator of the aeration device.
Figure 6:
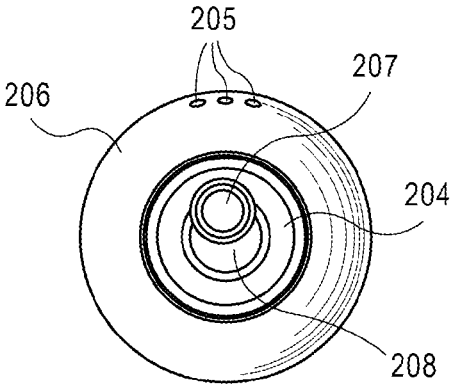
FIG. 6 depicts a back view of the aerator of the aeration device.

FIG. 4 depicts a perspective view of the aerator 200. FIG. 5 depicts a front view of the aerator 200, and FIG. 6 depicts the back view of the aerator 200. The different views illustrate how the first inner channel 207 and the second inner channel 208 extend parallel to each other inside the cylindrical casing 204, and mix inside the aeration chamber 206. The tab 203 is positioned to create a flow constriction for the liquid exiting the second inner channel 208. In the particular embodiment, the first inner channel 207 and the second inner channel 208 have circular cross sections; however, this is not a limitation of the inventive concept.

In the preceding specification, the inventive concept has been described with reference to specific exemplary embodiments. It will, however, be evident that various modifications and changes may be made without departing from the broader spirit and scope of the inventive concept as set forth in the claims that follow. The specification and drawings are accordingly to be regarded as illustrative rather than restrictive. Other embodiments of the inventive concept may be apparent to those skilled in the art from consideration of the specification and practice of the concept disclosed herein.

What is claimed is:

1. A liquid aerating device comprising:

a first inner channel through which air flows in a first direction;

a second inner channel extending substantially parallel to the first inner channel, wherein liquid flows through the second inner channel in a second direction that is opposite of the first direction;

an aeration chamber connected to the first inner channel and the second inner channel, the aeration chamber positioned such that the air flows into the first inner channel from the aeration chamber and the liquid flows out of the second inner channel into the aeration chamber; and a tab positioned at an outlet end of the second inner channel to block part of the liquid exiting the second inner channel.

2. The liquid aerating device of claim 1, wherein the first inner channel and the second inner channel have circular cross sections of different diameters.

3. The liquid aerating device of claim 2, wherein the first inner channel has a smaller diameter than the second inner channel.

4. The liquid aerating device of claim 1, further comprising holes on an outer wall of the aeration chamber.

5. The liquid aerating device of claim 1, wherein the first inner channel and the second inner channel are encased in a cylindrical casing having a tapered shape such that the cylindrical casing is narrower as it gets farther away from the aeration chamber.

6. The liquid aerating device of claim 5, wherein the first inner channel extends beyond a length of the cylindrical casing to form a straw attachment portion.

7. The liquid aerating device of claim 6, further comprising a straw attachable to the straw attachment portion.

8. The liquid aerating device of claim 1, further comprising a spout attachable to the aeration chamber.

9. The liquid aerating device of claim 8, wherein the spout includes a flow path with a constricted portion for liquid flow.

* * * * *